US010422566B2

(12) United States Patent
Hokazono et al.

(10) Patent No.: US 10,422,566 B2
(45) Date of Patent: Sep. 24, 2019

(54) AIR-CONDITIONING APPARATUS

(71) Applicant: Mitsubishi Electric Corporation, Tokyo (JP)

(72) Inventors: Keisuke Hokazono, Tokyo (JP); Yutaka Aoyama, Tokyo (JP); Kosuke Tanaka, Tokyo (JP); Takuya Matsuda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 75 days.

(21) Appl. No.: 14/888,101

(22) PCT Filed: Jun. 13, 2013

(86) PCT No.: PCT/JP2013/066405
§ 371 (c)(1),
(2) Date: Oct. 30, 2015

(87) PCT Pub. No.: WO2014/199501
PCT Pub. Date: Dec. 18, 2014

(65) Prior Publication Data

US 2016/0187049 A1 Jun. 30, 2016

(51) Int. Cl.
*F25D 17/06* (2006.01)
*F25B 41/06* (2006.01)
(Continued)

(52) U.S. Cl.
CPC ..... *F25D 17/06* (2013.01); *F25B 13/00* (2013.01); *F25B 39/00* (2013.01); *F25B 41/003* (2013.01);
(Continued)

(58) Field of Classification Search
CPC ... F28F 9/26; F28F 9/027; F28F 1/022; F28D 1/0417; F28D 1/05391; Y10T 137/87249; F25B 39/04; F25B 39/028; F25B 2339/04
See application file for complete search history.

(56) References Cited

U.S. PATENT DOCUMENTS 6,343,484 B1 * 2/2002 Hong ..... F04D 29/325 62/411
6,769,269 B2 * 8/2004 Oh ..... F25B 39/04 62/507
(Continued)

FOREIGN PATENT DOCUMENTS

CN 1265463 A 9/2000
CN 101592411 A 12/2009
(Continued)

OTHER PUBLICATIONS

"Machine Translation of JP 2009-287837A, Yoneda, Dec. 2009".*
(Continued)

*Primary Examiner* — Frantz F Jules
*Assistant Examiner* — Martha Tadesse
(74) *Attorney, Agent, or Firm* — Posz Law Group, PLC

(57) ABSTRACT

An air-conditioning apparatus, including: a heat source-side heat exchanger including a plurality of heat transfer tubes each having a flattened shape and being arranged in parallel, the heat source-side heat exchanger being used at least as a condenser of a refrigeration cycle; and an outdoor fan for generating flows of air passing through the heat source-side heat exchanger in a predetermined air velocity distribution. The heat source-side heat exchanger is configured to exchange heat between the air and refrigerant flowing through the heat transfer tubes and includes a plurality of refrigerant paths, each including at least one of the plurality of heat transfer tubes and a plurality of two-phase paths for allowing gas refrigerant to flow into and out as two-phase
(Continued)

refrigerant; and a plurality of liquid-phase paths for allowing the two-phase refrigerant flowing out of the plurality of two-phase paths to flow out as subcooled liquid refrigerant.

9 Claims, 6 Drawing Sheets

(51) Int. Cl.

| | |
|---|---|
| ***F25B 41/00*** | (2006.01) |
| ***F28D 1/053*** | (2006.01) |
| ***F25B 39/00*** | (2006.01) |
| ***F25B 13/00*** | (2006.01) |
| ***F28F 9/02*** | (2006.01) |
| ***F28D 1/047*** | (2006.01) |
| *F28D 21/00* | (2006.01) |
| *F25B 39/02* | (2006.01) |
| *F25B 39/04* | (2006.01) |

(52) U.S. Cl.
CPC ..... *F25B 41/067* (2013.01); *F28D 1/0478* (2013.01); *F28D 1/0535* (2013.01); *F28F 9/0246* (2013.01); *F25B 39/028* (2013.01); *F25B 39/04* (2013.01); *F25B 2313/0233* (2013.01); *F25B 2313/0294* (2013.01); *F25B 2500/01* (2013.01); *F28D 2021/007* (2013.01); *F28D 2021/0071* (2013.01)

(56) References Cited

U.S. PATENT DOCUMENTS

| | | | | |
|---|---|---|---|---|
| 9,062,919 | B2 * | 6/2015 | Hanafusa | F25B 39/04 |
| 2002/0134099 | A1 * | 9/2002 | Mochizuki | F24F 1/18 62/285 |
| 2009/0314020 | A1 * | 12/2009 | Yoshioka | F24F 1/0059 62/238.6 |
| 2011/0198065 | A1 * | 8/2011 | Hanafusa | F25B 39/04 165/173 |
| 2012/0103003 | A1 * | 5/2012 | Hokazono | F25B 13/00 62/401 |
| 2012/0318011 | A1 * | 12/2012 | Ochiai | F25B 49/005 62/127 |

FOREIGN PATENT DOCUMENTS

| | | | | | |
|---|---|---|---|---|---|
| EP | 1 031 801 | A2 | | 8/2000 | |
| EP | 1 953 480 | A1 | | 8/2008 | |
| EP | 2383529 | A1 | * | 11/2011 | F25B 13/00 |
| EP | EP 2383529 | A1 | * | 11/2011 | F25B 13/00 |
| JP | S57-131968 | A | | 8/1982 | |
| JP | 2000-074418 | A | | 3/2000 | |
| JP | 2000-249479 | A | | 9/2000 | |
| JP | 2000249479 | A | * | 9/2000 | F25B 39/00 |
| JP | 2002-228303 | A | | 8/2002 | |
| JP | 2003-056930 | A | | 2/2003 | |
| JP | 2007-120899 | A | | 5/2007 | |
| JP | 2008121984 | A | * | 5/2008 | |
| JP | 2009-287837 | A | | 12/2009 | |
| JP | 2009287837 | A | * | 12/2009 | |
| JP | 2010-249343 | A | | 11/2010 | |
| JP | 2012-102992 | A | | 5/2012 | |
| JP | 2012-149845 | A | | 8/2012 | |
| JP | 2012149845 | A | * | 8/2012 | |

OTHER PUBLICATIONS

"Machine Translation of JP 2007-120899A, Kinoshita, May 2007".*
"Machine Translation of JP 2010-249343A, Ishibashi, Nov. 2010".*
Office Action dated Aug. 29, 2016 issued in corresponding CN patent application No. 201380077344.6 (and English translation).
Office Action dated May 10, 2016 issued in corresponding JP patent application No. 2015-522358 (and English translation).
International Search Report of the International Searching Authority dated Sep. 3, 2013 for the corresponding international application No. PCT/JP2013/066405 (and English translation).
Second Chinese Office Action dated Mar. 10, 2017 issued in corresponding Chinese patent application No. 201380077344.6 (and English translation).
Extended European Search Report dated Dec. 20, 2016 issued in corresponding EP patent application No. 13886642.1.

* cited by examiner

AIR-CONDITIONING APPARATUS

CROSS REFERENCE TO RELATED APPLICATION

This application is a U.S. national stage application of PCT/JP2013/066405 filed on Jun. 13, 2013, the contents of which are incorporated herein by reference.

TECHNICAL FIELD

The present invention relates to an air-conditioning apparatus.

BACKGROUND ART

Air-conditioning apparatus as typified by multi-air conditioners for buildings each include a refrigerant circuit (refrigeration cycle) in which a plurality of indoor units to be independently operated are connected parallel to an outdoor unit (heat source unit). In general, such air-conditioning apparatus each include a four-way valve or other components to be used for switching passages in the refrigerant circuit, thereby being capable of performing a cooling operation and a heating operation. The indoor units each include an indoor heat exchanger (use-side heat exchanger) for exchanging heat between refrigerant flowing through the refrigerant circuit and indoor air, and the outdoor unit includes an outdoor heat exchanger (heat source-side heat exchanger) for exchanging heat between the refrigerant flowing through the refrigerant circuit and outside air. When the cooling operation is performed, the outdoor heat exchanger functions as a condenser, whereas the indoor heat exchanger functions as an evaporator. Meanwhile, when the heating operation is performed, the indoor heat exchanger functions as the condenser, whereas the outdoor heat exchanger functions as the evaporator. Hitherto, in the heat exchanger functioning as the condenser, liquid-phase portions (portions where condensed liquid-phase refrigerant is subcooled) are provided in downstream portions in each of refrigerant paths so that a necessary liquid temperature (necessary enthalpy) is secured in merging portions where flows of the liquid-phase refrigerant flowing out of each of the refrigerant paths are merged with each other.

Further, as heat transfer tubes of the heat exchanger, flat tubes may be used. The flat tubes are higher in heat transfer efficiency than circular tubes, and can be mounted to the heat exchanger at high density. However, internal passages of the flat tubes are capillaries, and hence refrigerant frictional pressure loss is increased particularly when the heat exchanger is used as the evaporator. As a measure to avoid this pressure loss, the number of refrigerant paths to be arranged parallel to each other is set larger in the heat exchanger using the flat tubes than in a heat exchanger using circular tubes.

CITATION LIST

Patent Literature

Patent Literature 1: Japanese Unexamined Patent Application Publication No. 2012-149845

SUMMARY OF INVENTION

Technical Problem

However, in the heat exchanger using the flat tubes, when a refrigerant flow rate is decreased during, for example, a partial load operation (low-load operation), the flow rate is significantly decreased in each of the refrigerant paths. In addition, the flat tubes are mounted at high density and excellent in efficiency, and hence a heat exchange capacity (AK value) is increased in the heat exchanger using the flat tubes. Thus, in each of the refrigerant paths, a proportion of the liquid-phase portions is increased. As a result, there arises a problem in that efficiency of heat exchange is decreased.

The present invention has been made to solve the problem as described above, and it is an object thereof to provide an air-conditioning apparatus capable of enhancing efficiency of heat exchange.

Solution to Problem

According to one embodiment of the present invention, there is provided an air-conditioning apparatus, including: a heat exchanger including a plurality of heat transfer tubes each having a flattened shape and being arranged in parallel to each other, the heat exchanger being used at least as a condenser of a refrigeration cycle; and a fan for generating flows of air passing through the heat exchanger in a predetermined air velocity distribution, the heat exchanger being configured to exchange heat between the air and refrigerant flowing through the plurality of heat transfer tubes, the heat exchanger including a plurality of refrigerant paths each including at least one of the plurality of heat transfer tubes, the plurality of refrigerant paths including: a plurality of first refrigerant paths for allowing gas refrigerant to flow into the plurality of first refrigerant paths and allowing the gas refrigerant to flow out as two-phase refrigerant; and a plurality of second refrigerant paths for allowing the two-phase refrigerant flowing out of the plurality of first refrigerant paths to flow into the plurality of second refrigerant paths, and to flow out as subcooled liquid refrigerant, the plurality of second refrigerant paths being arranged in a region lower in velocity of the air than a region where the plurality of first refrigerant paths are arranged.

Advantageous Effects of Invention

According to the one embodiment of the present invention, the first refrigerant paths are arranged in the region that is relatively high in air velocity, whereas the second refrigerant paths are arranged in the region that is relatively low in air velocity. With this, a proportion of the liquid-phase portions in the heat transfer tubes 20 can be reduced, and hence the efficiency of heat exchange can be enhanced.

DESCRIPTION OF EMBODIMENTS

Embodiment 1

Figure 1:
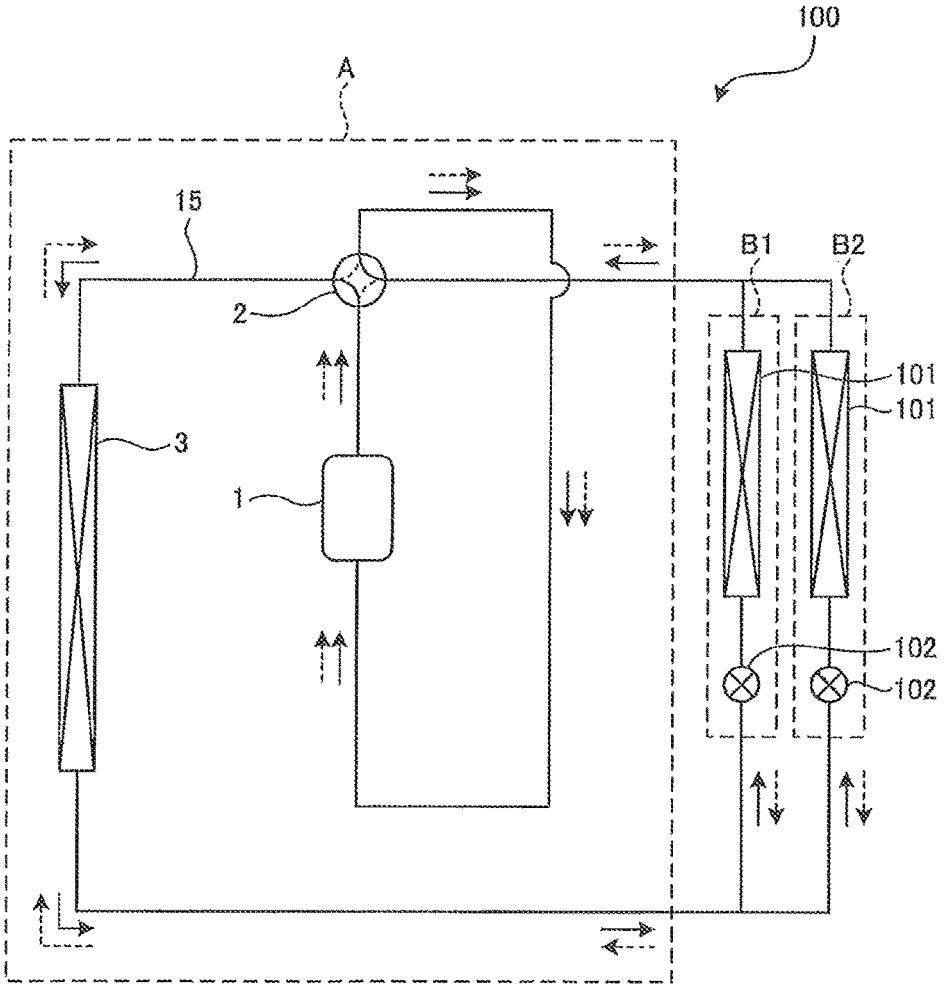
FIG. 1 is a refrigerant circuit diagram illustrating a refrigerant circuit configuration of an air-conditioning apparatus 100 according to Embodiment 1 of the present invention.

Description is made of an air-conditioning apparatus according to Embodiment 1 of the present invention. FIG. 1 is a refrigerant circuit diagram illustrating a refrigerant circuit configuration of an air-conditioning apparatus 100 according to this embodiment. With reference to FIG. 1, description is made of the refrigerant circuit configuration and an operation of the air-conditioning apparatus 100 that is one of refrigeration cycle apparatus. The air-conditioning apparatus 100 is configured to perform a cooling operation or a heating operation through use of a refrigeration cycle (heat pump cycle) for circulating refrigerant. Note that, in FIG. 1, a flow of the refrigerant during the cooling operation is indicated by the solid-line arrows, and a flow of the refrigerant during the heating operation is indicated by the broken-line arrows. Further, in FIG. 1 and subsequent drawings, size relationships between components may be different from actual size relationships.

As illustrated in FIG. 1, the air-conditioning apparatus 100 includes one outdoor unit A (heat source unit), and two indoor units (indoor unit B1 and indoor unit B2) connected parallel to the outdoor unit A. The outdoor unit A and the indoor units B1 and B2 are connected to each other through refrigerant pipes 15 including gas pipes and liquid pipes. Thus, in the air-conditioning apparatus 100, a refrigerant circuit includes the outdoor unit A and the indoor units B1 and B2. The refrigerant is circulated in this refrigerant circuit, thereby being capable of performing the cooling operation or the heating operation. Note that, in the following description, the indoor unit B1 and the indoor unit B2 may be collectively referred to as indoor units B. Further, the numbers of the outdoor units A and the indoor units B to be connected are not limited to the numbers of those units illustrated in FIG. 1.

The outdoor unit A has a function to supply cooling energy to the indoor units B. In the outdoor unit A, a compressor 1, a four-way valve 2, and a heat source-side heat exchanger 3 (outdoor heat exchanger) are arranged so as to establish serial connection during the cooling operation.

The compressor 1 is configured to suck and compress the refrigerant into a high-pressure and high-temperature state. Examples of the compressor 1 may include an inverter compressor capable of capacity control. The four-way valve 2 functions as a flow switching device for switching the flows of the refrigerant, specifically, switching the flow of the refrigerant during the cooling operation and the flow of the refrigerant during the heating operation to each other.

The heat source-side heat exchanger 3 is configured to exchange heat between air supplied by an outdoor fan 50 (refer to FIG. 4) and the refrigerant flowing through an inside of the heat source-side heat exchanger 3. The heat source-side heat exchanger 3 functions as a condenser (radiator) during the cooling operation to condense and liquefy the refrigerant (or bring the refrigerant into a high density supercritical state). Further, the heat source-side heat exchanger 3 functions as an evaporator during the heating operation to evaporate and gasify the refrigerant.

Figure 2:
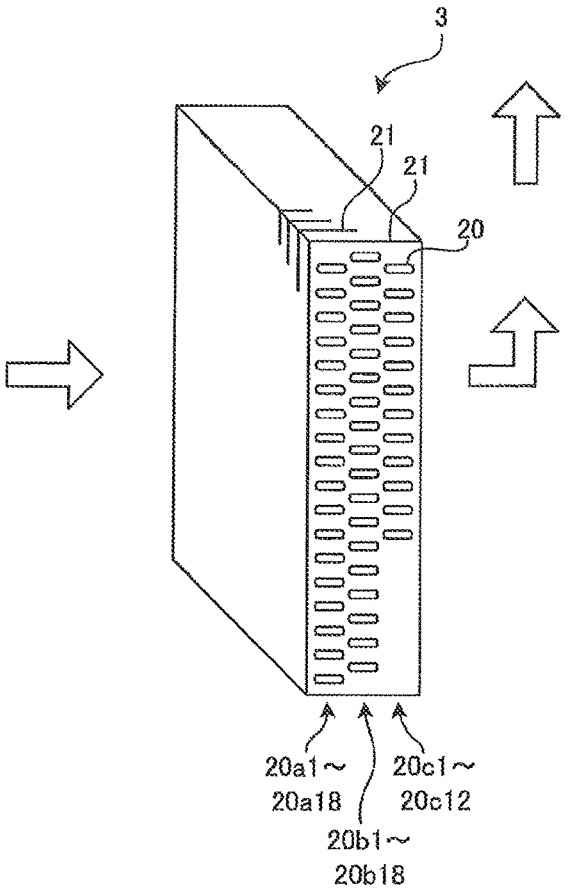
FIG. 2 is a perspective view illustrating a schematic configuration of a heat source-side heat exchanger 3 of the air-conditioning apparatus 100 according to Embodiment 1 of the present invention.

FIG. 2 is a perspective view illustrating a schematic configuration of the heat source-side heat exchanger 3. As illustrated in FIG. 2, the heat source-side heat exchanger 3 is a heat exchanger of a cross fin type, including a plurality of rectangular flat-plate-like heat transfer fins 21 arranged parallel to each other, and a plurality of heat transfer tubes 20 arranged parallel to each other and passing through the heat transfer fins 21. Flat tubes each having a flattened shape (for example, porous flat tubes) are used as the heat transfer tubes 20. Outside air is sucked by the outdoor fan 50 through lateral surfaces, and blown out upward through the heat source-side heat exchanger 3. In this way, an air flow is generated around the heat source-side heat exchanger 3 (in FIG. 2, direction of the air flow is indicated by the thick arrows). The heat transfer tubes 20 are arrayed in three rows along a thickness direction of the heat source-side heat exchanger 3 (direction of the air flow). When those rows are defined as a first row to a third row from an upstream side toward a downstream side of the air flow, eighteen heat transfer tubes 20 are arrayed in each of the first row and the second row, and twelve heat transfer tubes 20 are arrayed in the third row. Now, the eighteen heat transfer tubes 20 in the first row may be independently referred to as heat transfer tubes 20*a*1, 20*a*2, . . . , and 20*a*18 from top to bottom, the eighteen heat transfer tubes 20 in the second row may be independently referred to as heat transfer tubes 20*b*1, 20*b*2, . . . , and 20*b*18 from top to bottom, and the twelve heat transfer tubes 20 in the third row may be independently referred to as heat transfer tubes 20*c*1, 20*c*2, . . . , and 20*c*12 from top to bottom.

Further, the heat source-side heat exchanger 3 includes a plurality of refrigerant paths each including one or a plurality of heat transfer tubes 20. When one refrigerant path includes the plurality of heat transfer tubes 20, end portions of those heat transfer tubes 20 (end portions in the near side, or end portions on the far side in FIG. 2) are connected to each other through U-shaped tubes (not shown). Flat tubes each having a flattened shape in cross-section are used as the U-shaped tubes. The refrigerant paths include a plurality of two-phase paths (first refrigerant paths) and a plurality of liquid-phase paths (second refrigerant paths). The two-phase paths are refrigerant paths for allowing gas refrigerant to flow thereinto and to flow out in a form of two-phase gas-liquid refrigerant that does not become a saturated liquid (for example, low-quality two-phase refrigerant that is almost a saturated liquid) when the heat source-side heat exchanger 3 functions as the condenser. The liquid-phase paths are refrigerant paths for allowing the two-phase gas-liquid refrigerant flowing out of the two-phase paths to flow thereinto, and to flow out in a form of subcooled liquid refrigerant. Detailed description of a specific example of patterns of the refrigerant paths of the heat source-side heat exchanger 3 is made later.

Referring back to FIG. 1, the indoor units B are each installed, for example, in a room having an air-conditioned space, and have a function to supply cooling air or heating air into the air-conditioned space. In each of the indoor units B, a use-side heat exchanger 101 (indoor heat exchanger) and an expansion device 102 are arranged to establish serial connection. The use-side heat exchanger 101 is configured to exchange heat between air supplied from an indoor fan (not shown) and refrigerant flowing through an inside of the use-side heat exchanger 101. The use-side heat exchanger 101 functions as the evaporator during the cooling operation to generate cooling air to be supplied to the air-conditioned space. Further, the use-side heat exchanger 101 functions as the condenser (radiator) during the heating operation to generate heating air to be supplied to the air-conditioned space. The expansion device 102 is configured to expand the refrigerant through decompression, and control distribution of the refrigerant into the use-side heat exchanger 101. As an example of this expansion device 102, there may be given an electronic expansion valve that can be adjusted in opening degree.

Description is made of the flow of the refrigerant during the cooling operation of the air-conditioning apparatus 100 (solid-line arrows in FIG. 1). When the air-conditioning apparatus 100 performs the cooling operation, the four-way valve 2 is switched so that refrigerant discharged from the compressor 1 is caused to flow into the heat source-side heat exchanger 3, and then the compressor 1 is driven. Refrigerant sucked into the compressor 1 is brought into a high-pressure and high-temperature gas state by the compressor 1, and then discharged to flow into the heat source-side heat exchanger 3 through the four-way valve 2. The refrigerant flowing into the heat source-side heat exchanger 3 becomes high-pressure and high-temperature liquid refrigerant by being cooled through the heat exchange between the refrigerant and the air supplied by the outdoor fan 50, and then flows out of the heat source-side heat exchanger 3.

The liquid refrigerant flowing out of the heat source-side heat exchanger 3 flows into the indoor units B. The refrigerant flowing into the indoor units B becomes low-pressure two-phase gas-liquid refrigerant through the decompression by the expansion devices 102. This low-pressure two-phase refrigerant flows into the use-side heat exchangers 101, and is evaporated and gasified by receiving heat from the air supplied from the indoor fans. At this time, the air cooled through heat reception by the refrigerant is supplied as the cooling air into the air-conditioned space in the room or the like. In this way, the cooling operation in the air-conditioned space is performed. The refrigerant flowing out of the use-side heat exchangers 101 flows out of the indoor units B into the outdoor unit A. The refrigerant flowing into the outdoor unit A is sucked into the compressor 1 again through the four-way valve 2.

Next, description is made of the flow of the refrigerant during the heating operation of the air-conditioning apparatus 100 (broken-line arrows in FIG. 1). When the air-conditioning apparatus 100 performs the heating operation, the four-way valve 2 is switched so that the refrigerant discharged from the compressor 1 is caused to flow into the use-side heat exchangers 101, and then the compressor 1 is driven. The refrigerant sucked into the compressor 1 is brought into the high-pressure and high-temperature gas state by the compressor 1, and then discharged to flow into the use-side heat exchangers 101 through the four-way valve 2. The refrigerant flowing into the use-side heat exchangers 101 becomes high-pressure and high-temperature liquid refrigerant by being cooled through the heat exchange between the refrigerant and the air supplied from the indoor fans. At this time, the air heated through heat transfer from the refrigerant is supplied as the heating air into the air-conditioned space in the room. In this way, the heating operation in the air-conditioned space can be performed.

The liquid refrigerant flowing out of the use-side heat exchangers 101 becomes the low-pressure two-phase gas-liquid refrigerant through the decompression by the expansion devices 102. This low-pressure two-phase refrigerant flows out of the indoor units B into the outdoor unit A. The low-pressure two-phase refrigerant flowing into the outdoor unit A flows into the heat source-side heat exchanger 3, and is evaporated and gasified by receiving heat from the air supplied by the outdoor fan 50. This low-pressure gas refrigerant flows out of the heat source-side heat exchanger 3, and then is sucked into the compressor 1 again through the four-way valve 2.

Incidentally, in the cooling operation, the high-pressure and high-temperature gas state refrigerant, which is discharged from the compressor 1 and flows into the heat source-side heat exchanger 3 through the four-way valve 2, first flows into any one of the two-phase paths out of the plurality of two-phase paths arranged in parallel to each other in the heat source-side heat exchanger 3. The gas refrigerant flowing into the two-phase path is cooled by the heat exchange between the gas refrigerant and the air, and once flows out of the heat source-side heat exchanger 3 (two-phase path) in the state of the two-phase gas-liquid refrigerant that does not become a saturated liquid. The two-phase gas-liquid refrigerant flowing out of the two-phase path in the heat source-side heat exchanger 3 flows into a liquid-phase path out of the plurality of liquid-phase paths arranged in parallel to each other in the heat source-side heat exchanger 3. The liquid-phase path corresponds to the two-phase path from which the two-phase gas-liquid refrigerant flows out. The two-phase gas-liquid refrigerant flowing into the liquid-phase path is cooled by the heat exchange between the two-phase gas-liquid refrigerant and the air, becomes the saturated liquid from the two-phase state, and then becomes a subcooled liquid to flow out of the liquid-phase path. The subcooled liquid refrigerant flowing out of the liquid-phase path merges with refrigerant that similarly becomes a subcooled liquid in another liquid-phase path. In this way, the subcooled liquid refrigerant becomes the high-pressure and high-temperature liquid refrigerant, and flows out of the heat source-side heat exchanger 3. The liquid refrigerant flowing out of the heat source-side heat exchanger 3 flows into the indoor units B.

Figure 3:
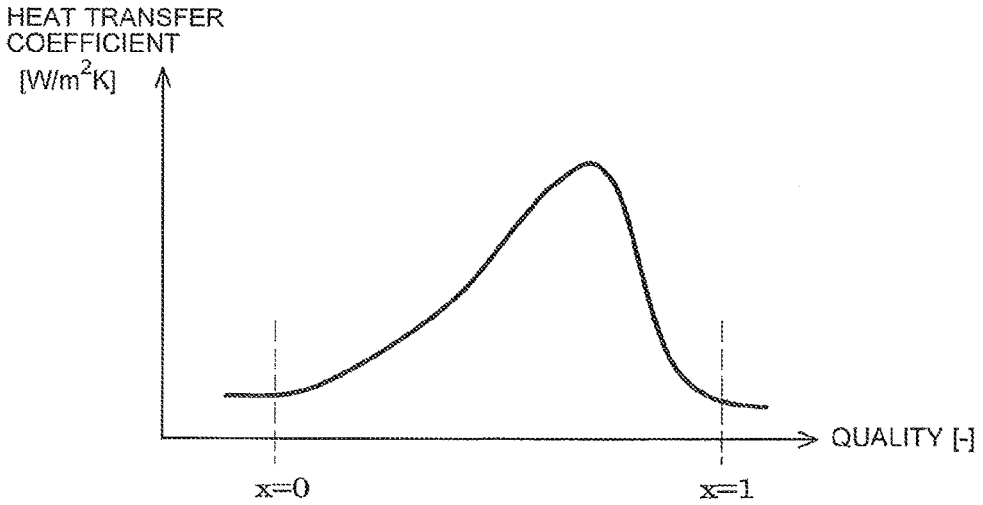
FIG. 3 is a graph showing a relationship between a quality of refrigerant and a coefficient of heat transfer of the refrigerant in the heat source-side heat exchanger 3 of the air-conditioning apparatus 100 according to Embodiment 1 of the present invention.

In this context, with reference to FIG. 3, description is made of a relationship between a quality of the refrigerant and a coefficient of heat transfer of the refrigerant in the heat source-side heat exchanger 3 during the cooling operation. FIG. 3 is a graph showing the relationship between the quality of the refrigerant and the coefficient of the heat transfer of the refrigerant in the heat source-side heat exchanger 3. High-temperature and high-pressure superheated gas refrigerant flows into an inlet end of a refrigerant passage in the heat source-side heat exchanger 3 (in this example, inlet end of the two-phase path). Then, this superheated gas is condensed into the two-phase refrigerant through heat transfer to tube-outside air while flowing through the refrigerant passage in the heat source-side heat exchanger 3, and finally flows out of an outlet end of the refrigerant passage (in this example, outlet end of the liquid-phase path) in the state of the subcooled liquid refrigerant. Note that, as shown in FIG. 3, the heat transfer coefficient in an inside of the heat transfer tubes varies depending on the quality of the refrigerant. Thus, the plurality of heat transfer tubes in the heat source-side heat exchanger 3 include portions for allowing single-phase refrigerant (superheated gas refrigerant or subcooled liquid refrigerant) to pass therethrough (single-phase portions), and portions other than the single-phase portions, for allowing the two-phase refrigerant to pass therethrough (two-phase portions). In the heat source-side heat exchanger 3 of this example, the two-phase paths for causing the gas refrigerant to become the low-quality two-phase refrigerant include the single-phase portions (gas-phase portions) and the two-phase portions occupying most of a downstream side with respect to those single-phase portions. Further, the liquid-phase paths for causing the low-quality two-phase refrigerant to become the subcooled liquid refrigerant include the two-phase portions and the single-phase portions (liquid-phase portions) occupying most of a downstream side with respect to those two-phase portions.

Figure 4:
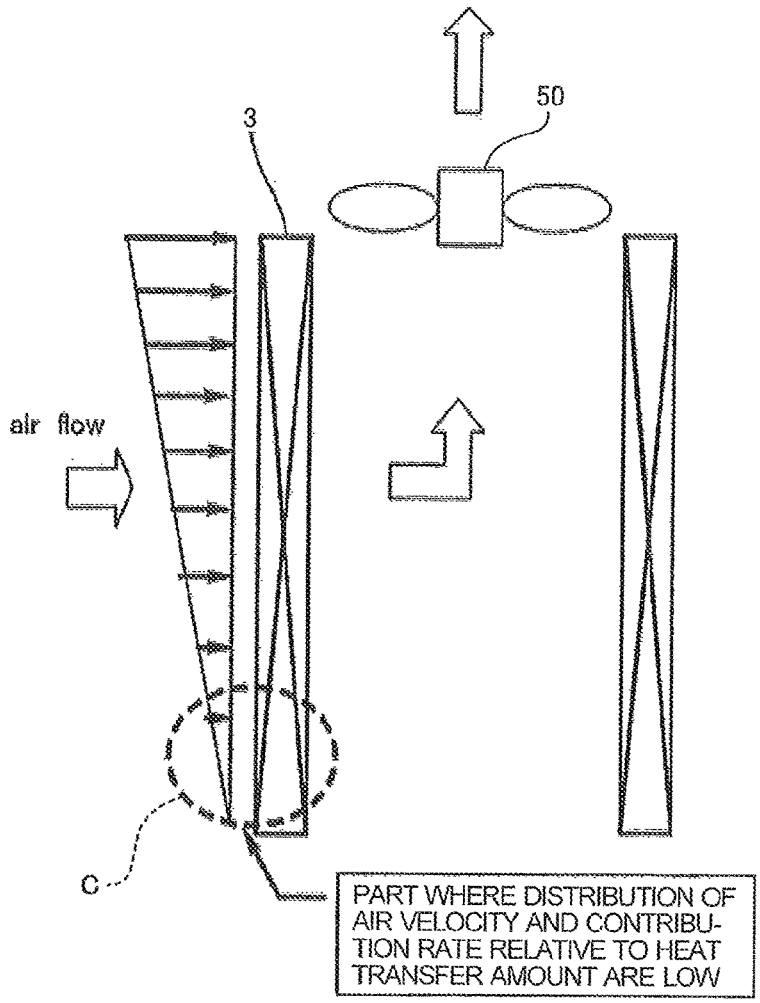
FIG. 4 is an explanatory view illustrating an example of an air velocity distribution on a surface of the heat source-side heat exchanger 3 of the air-conditioning apparatus 100 according to Embodiment 1 of the present invention.

FIG. 4 is an explanatory view illustrating an example of an air velocity distribution on a surface of the heat source-side heat exchanger 3. In FIG. 4, the outdoor fan 50 for supplying air to the heat source-side heat exchanger 3 is also illustrated. When the outdoor unit A is configured, for example, to suck the outside air through the lateral surfaces, and to blow out upward the air passing through the heat source-side heat exchanger 3, as illustrated in FIG. 4, on the surface of the heat source-side heat exchanger 3, there is generated such an air velocity distribution that an air velocity is increased toward an upper portion close to the outdoor fan 50 and the air velocity is decreased toward a lower portion far from the outdoor fan 50. When such an air velocity distribution is generated, in the lower portion where the air velocity is low (portion C in FIG. 4), a contribution rate relative to a heat transfer amount of the entire heat source-side heat exchanger 3 is low. However, even in the lower portion where the air velocity is low, a heat transfer amount sufficient to cause the two-phase refrigerant, which is almost the saturated liquid, to become the subcooled liquid is secured.

Next, description is made of a heat exchange amount Q in the heat source-side heat exchanger 3. The heat exchange amount Q [W] is expressed by the following expression (1), where K [$W/m^2K$] is an overall heat transfer coefficient, $\Delta t$ [K] is a temperature difference between the refrigerant and the air, and Ao [$m^2$] is a tube-outside heat transfer area.

[Math 1]

$$Q = Ao \times K \times \Delta t \tag{1}$$

Therefore, when the tube-outside heat transfer area Ao of the heat source-side heat exchanger 3 and the temperature difference $\Delta t$ between the refrigerant and the air remain the same, the heat exchange amount Q is large when the overall heat transfer coefficient K is increased, that is, the heat exchanger has high performance. Further, the overall heat transfer coefficient K is expressed by the following expression (2), where $\alpha o$ is a tube-outside (air-side) heat transfer coefficient, Rt is a heat resistance of a tube thick portion, $\alpha i$ is a tube-inside (refrigerant-side) heat transfer coefficient, Ao is a tube-outside heat transfer area, and Ai is a tube-inside heat transfer area.

[Math 2]

$$\frac{1}{K} = \frac{1}{\alpha o} + Rt + \frac{Ao}{Ai}\frac{1}{\alpha i} \tag{2}$$

Figure 5:
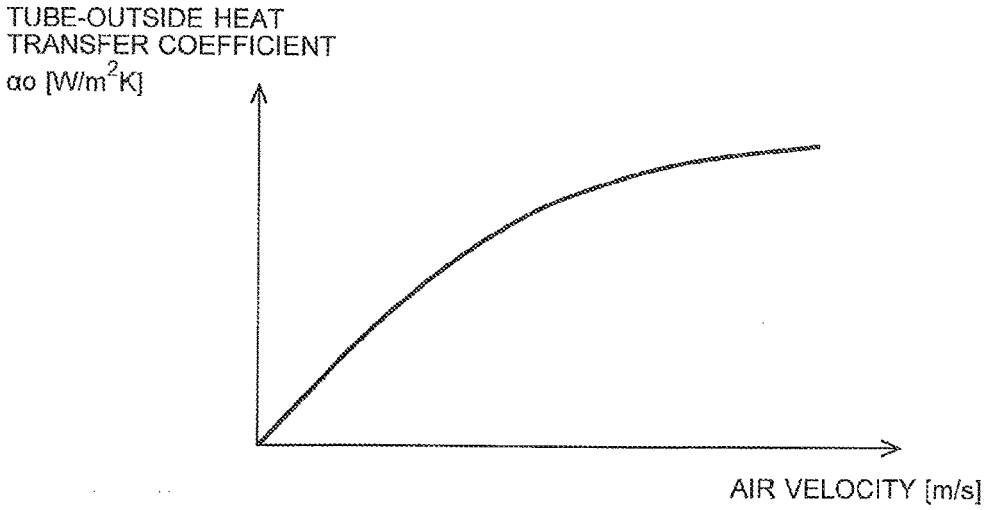
FIG. 5 is a graph showing a relationship between a tube-outside heat transfer coefficient αo and an air velocity of the heat source-side heat exchanger 3 of the air-conditioning apparatus 100 according to Embodiment 1 of the present invention.

FIG. 5 is a graph showing a relationship between the tube-outside heat transfer coefficient $\alpha o$ and the air velocity. As shown in FIG. 5, in general, the tube-outside heat transfer coefficient $\alpha o$ varies based on a power function relative to the air velocity, and hence is increased in accordance with increase in air velocity.

Figure 6:
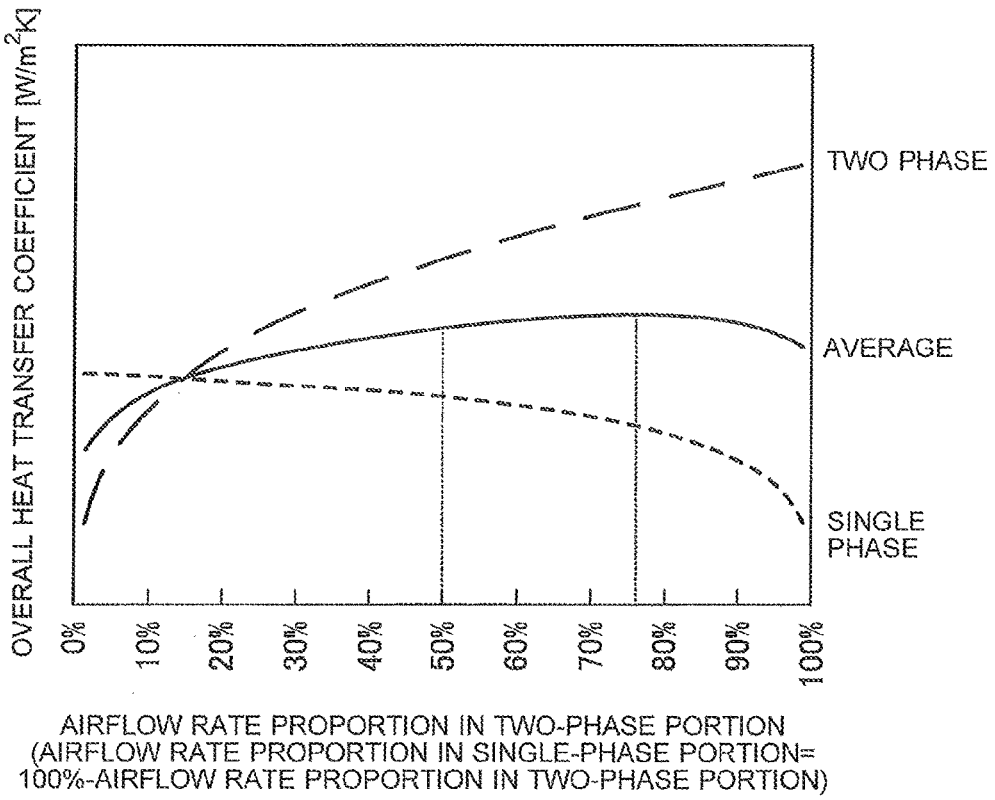
FIG. 6 is a graph showing a relationship between an overall heat transfer coefficient and a flow rate of air passing through single-phase portions and two-phase portions in the heat source-side heat exchanger 3 of the air-conditioning apparatus 100 according to Embodiment 1 of the present invention.

FIG. 6 is a graph showing a relationship between the overall heat transfer coefficient and a flow rate of air passing through the single-phase portions and the two-phase portions in the heat source-side heat exchanger 3. FIG. 6 shows the overall heat transfer coefficients in the single-phase portions and the two-phase portions, and an average overall heat transfer coefficient therebetween when airflow rate proportions (air velocity ratio) in the two-phase portions and the single-phase portions are varied under a state in which the flow rate of the air sucked by the outdoor fan 50 to the heat source-side heat exchanger 3 is set uniform. As shown in FIG. 6, comparisons with the state in which the air velocity is evenly distributed in the two-phase portions and the single-phase portions (state in which an airflow rate proportion in the two-phase portions is 50%) demonstrate that the average overall heat transfer coefficient is the highest when the airflow rate proportion in the two-phase portions is approximately 76% (airflow rate proportion in the single-phase portions is approximately 24%). In other words, the tube-inside heat transfer coefficient $\alpha i$ in the two-phase portions is higher than the tube-inside heat transfer coefficient $\alpha i$ in the single-phase portions, and hence the average overall heat transfer coefficient can be maximized when the airflow rate proportion in the two-phase portions is set high.

Therefore, it is desired that the heat source-side heat exchanger 3 and the outdoor fan 50 have such an arrangement relationship that the heat transfer tubes of the single-phase portions are arranged in a region that allows air having a low air velocity to pass therethrough. Thus, air having a high air velocity generally passes on an outside of the heat transfer tubes of the two-phase portions. As shown in FIG. 3, a heat transfer coefficient of the two-phase refrigerant having a quality of from 0.4 to 0.9 is particularly high, and hence it is desired that the heat transfer tube that allows the refrigerant having the quality of from 0.4 to 0.9 to pass therethrough be arranged in a region that allows the air having a higher air velocity to pass therethrough. Note that, whether the air velocity is high or low is based on an average velocity of the air on the surface of the heat source-side heat exchanger 3, which is sucked by the outdoor fan 50, but the criterion is not particularly limited thereto.

Figure 7:
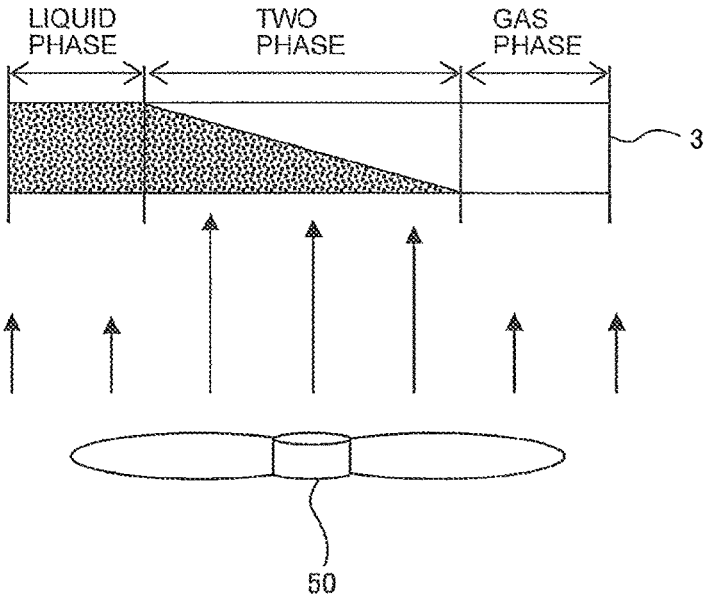
FIG. 7 is a conceptual diagram illustrating a relationship between the air velocity distribution and states of the refrigerant in the heat transfer tubes in the heat source-side heat exchanger 3 of the air-conditioning apparatus 100 according to Embodiment 1 of the present invention.

FIG. 7 is a conceptual diagram illustrating a relationship between the air velocity distribution and states of the refrigerant in the heat transfer tubes in the heat source-side heat exchanger 3. As illustrated in FIG. 7, the outdoor fan 50 of this example generates such an air velocity distribution that the air velocity is high at a central portion of the heat source-side heat exchanger 3, and low at both end portions thereof. In this case, the single-phase portions having a low tube-inside heat transfer coefficient (for example, the gas-phase portions on an inlet side, and the liquid-phase portions on an outlet side) are arranged in regions where the air velocity and the tube-outside heat transfer coefficient (convective heat transfer coefficient) are low (in this example, both the end portions of the heat source-side heat exchanger 3). The two-phase portions having a high tube-inside heat transfer coefficient are arranged in a region where the air velocity and the tube-outside heat transfer coefficient are high (in this example, the central portion of the heat source-side heat exchanger 3). With this, the overall heat transfer coefficient of the entire heat source-side heat exchanger 3 can be increased, and hence efficiency of heat exchange can be enhanced. Further, in the two-phase portions, when parts having a high tube-inside heat transfer coefficient (for example, parts where the two-phase refrigerant has the quality of from 0.4 to 0.9) are arranged in a region where air to flow therein is increased in tube-outside heat transfer coefficient, the efficiency of heat exchange can be further enhanced. With this, energy efficiency can be enhanced.

In this embodiment, the two-phase paths are mostly occupied by the two-phase portions, and the liquid-phase paths are mostly occupied by the single-phase portions (liquid-phase portions). Thus, in this embodiment, the two-phase paths are arranged in the regions where the air velocity is high, and the liquid-phase paths are arranged in the regions where the air velocity is low. With this, the overall heat transfer coefficient of the entire heat source-side heat exchanger 3 can be increased, and hence the efficiency of heat exchange can be enhanced.

Figure 8:
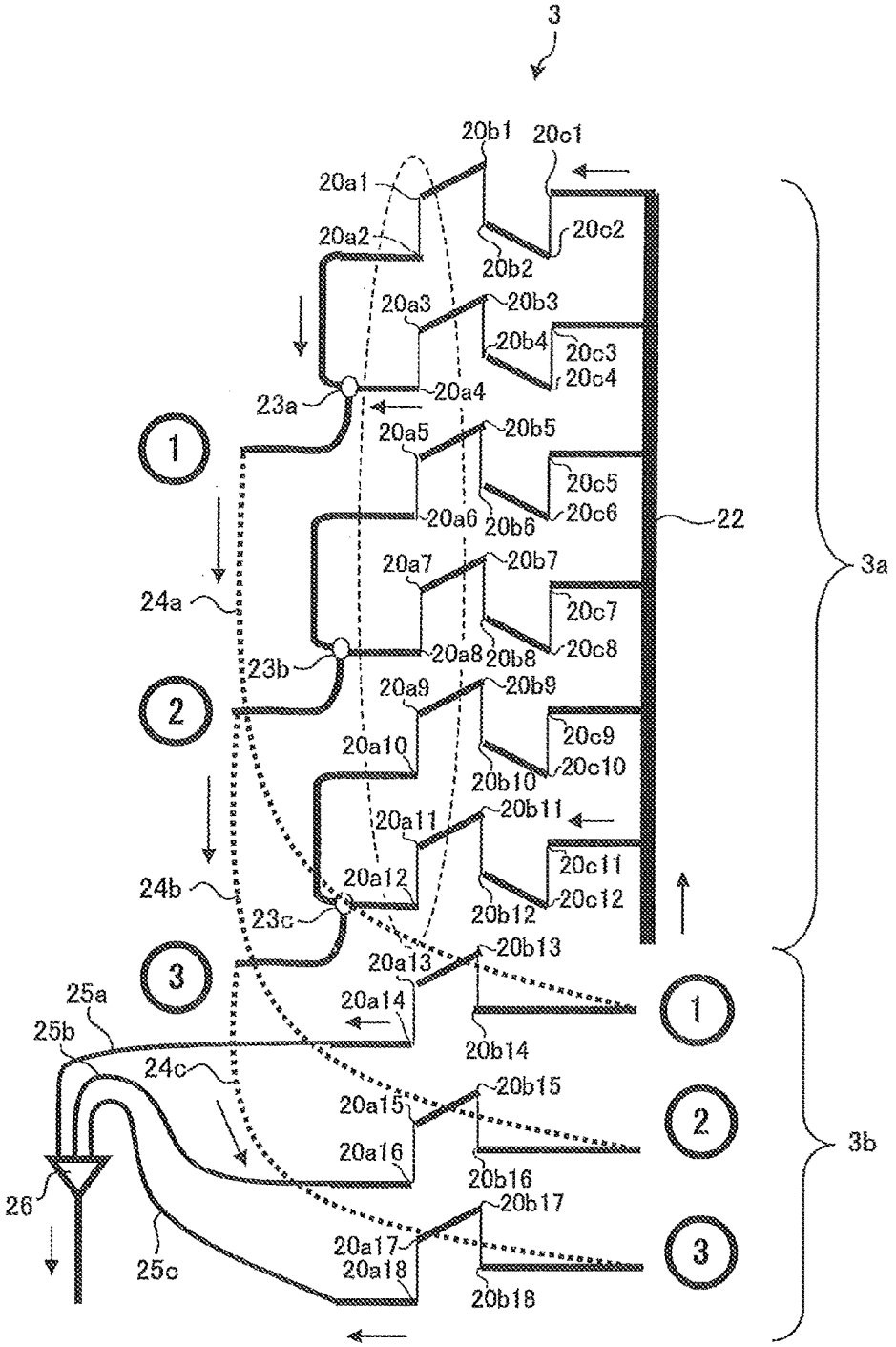
FIG. 8 is a diagram illustrating an example of a refrigerant path pattern of the heat source-side heat exchanger 3 of the air-conditioning apparatus 100 according to Embodiment 1 of the present invention.

FIG. 8 is a diagram illustrating an example of a refrigerant path pattern of the heat source-side heat exchanger 3 illustrated in FIG. 2. A flow direction of the refrigerant at the time when the heat source-side heat exchanger 3 functions as the condenser is indicated by the straight arrows in FIG. 8. The flow direction of the refrigerant is reversed at the time when the heat source-side heat exchanger 3 functions as the evaporator. The refrigerant path pattern illustrated in FIG. 8 is designed in accordance with the air velocity distribution in the heat source-side heat exchanger 3 arranged along lateral surfaces (for example, three surfaces including both lateral surfaces and a rear surface) of the outdoor unit A (heat source unit) having such an air flow system that the outside air is sucked through those lateral surfaces and blown out through an upper surface. In such a heat source-side heat exchanger 3, as illustrated in FIG. 4, there is generated such an air velocity distribution that the air velocity is increased toward the upper portion and the air velocity is decreased toward the lower portion. Thus, in the heat source-side heat exchanger 3 illustrated in FIG. 8, the plurality of two-phase paths are arranged collectively in an upper region 3*a* where the air velocity is high, and the plurality of liquid-phase paths are arranged collectively in a lower region 3*b* where the air velocity is low. In this example, six two-phase paths and three liquid-phase paths are arranged. Note that, the numbers of the two-phase paths and the liquid-phase paths are not limited to the numbers of the paths illustrated in FIG. 8. Further in this example, pairs of two-phase paths are merged at merging portions 23*a*, 23*b*, and 23*c* described later, and hence the pairs of the two-phase paths each include two inlets and one outlet. Thus, as many as the liquid-phase paths, the two-phase paths may be considered as three two-phase paths.

Now, detailed description is made of the refrigerant path pattern of this example. A gas-side header portion 22 is located on an inlet side of the heat source-side heat exchanger 3 when the heat source-side heat exchanger 3 functions as the condenser. The gas-side header portion 22 is connected to respective end portions of the heat transfer tubes 20*c*1, 20*c*3, 20*c*5, 20*c*7, 20*c*9, and 20*c*11 on one side (for example, end portions on the near side).

An end portion of the heat transfer tube 20*c*1 on the far side is connected to an end portion of the heat transfer tube 20*c*2 on the far side through the U-shaped tube. An end portion of the heat transfer tube 20*c*2 on the near side is connected to an end portion of the heat transfer tube 20*b*2 on the near side through the U-shaped tube. An end portion of the heat transfer tube 20*b*2 on the far side is connected to an end portion of the heat transfer tube 20*b*1 on the far side through the U-shaped tube. An end portion of the heat transfer tube 20*b*1 on the near side is connected to an end portion of the heat transfer tube 20*a*1 on the near side through the U-shaped tube. An end portion of the heat transfer tube 20*a*1 on the far side is connected to an end portion of the heat transfer tube 20*a*2 on the far side through the U-shaped tube. The six heat transfer tubes 20*c*1, 20*c*2, 20*b*2, 20*b*1, 20*a*1, and 20*a*2 form one two-phase path together with, for example, the U-shaped tubes connecting the end portions thereof to each other. An outlet side of this two-phase path (end portion of the heat transfer tube 20*a*2 on the near side) is connected to the merging portion 23*a*.

An end portion of the heat transfer tube 20*c*3 on the far side is connected to an end portion of the heat transfer tube 20*c*4 on the far side through the U-shaped tube. An end portion of the heat transfer tube 20*c*4 on the near side is connected to an end portion of the heat transfer tube 20*b*4 on the near side through the U-shaped tube. An end portion of the heat transfer tube 20*b*4 on the far side is connected to an end portion of the heat transfer tube 20*b*3 on the far side through the U-shaped tube. An end portion of the heat transfer tube 20*b*3 on the near side is connected to an end portion of the heat transfer tube 20*a*3 on the near side through the U-shaped tube. An end portion of the heat transfer tube 20*a*3 on the far side is connected to an end portion of the heat transfer tube 20*a*4 on the far side through the U-shaped tube. The six heat transfer tubes 20*c*3, 20*c*4, 20*b*4, 20*b*3, 20*a*3, and 20*a*4 form one two-phase path together with, for example, the U-shaped tubes connecting the end portions thereof to each other. An outlet side of this two-phase path (end portion of the heat transfer tube 20*a*4 on the near side) is connected to the merging portion 23*a*.

Similarly, the six heat transfer tubes 20*c*5, 20*c*6, 20*b*6, 20*b*5, 20*a*5, and 20*a*6 form one two-phase path together with, for example, the U-shaped tubes connecting end portions thereof to each other. The six heat transfer tubes 20*c*7, 20*c*8, 20*b*8, 20*b*7, 20*a*7, and 20*a*8 form one two-phase path together with, for example, the U-shaped tubes connecting end portions thereof to each other. Both outlet sides of those two-phase paths (end portion of the heat transfer tube 20*a*6 on the near side and end portion of the heat transfer tube 20*a*8 on the near side) are connected to the merging portion 23*b*.

Further, the six heat transfer tubes 20*c*9, 20*c*10, 20*b*10, 20*b*9, 20*a*9, and 20*a*10 form one two-phase path together with, for example, the U-shaped tubes connecting end portions thereof to each other. The six heat transfer tubes 20*c*11, 20*c*12, 20*b*12, 20*b*11, 20*a*11, and 20*a*12 form one two-phase path together with, for example, the U-shaped tubes connecting end portions thereof to each other. Both outlet sides of those two-phase paths (end portion of the heat transfer tube 20*a*10 on the near side and end portion of the heat transfer tube 20*a*12 on the near side) are connected to the merging portion 23*c*.

The merging portion 23*a* is connected to an end portion of the heat transfer tube 20*b*14 on the near side through a coupling tube 24*a*. An end portion of the heat transfer tube 20*b*14 on the far side is connected to an end portion of the heat transfer tube 20*b*13 on the far side through the U-shaped tube. An end portion of the heat transfer tube 20*b*13 on the near side is connected to an end portion of the heat transfer tube 20*a*13 on the near side through the U-shaped tube. An end portion of the heat transfer tube 20*a*13 on the far side is connected to an end portion of the heat transfer tube 20*a*14 on the far side through the U-shaped tube. The four heat transfer tubes 20*b*14, 20*b*13, 20*a*13, and 20*a*14 form one liquid-phase path together with, for example, the U-shaped tubes connecting the end portions thereof to each other. An outlet side of this liquid-phase path (end portion of the heat transfer tube 20*a*14 on the near side) is connected to a distributor 26 through a capillary 25*a*.

The merging portion 23*b* is connected to an end portion of the heat transfer tube 20*b*16 on the near side through a coupling tube 24*b*. An end portion of the heat transfer tube 20*b*16 on the far side is connected to an end portion of the heat transfer tube 20*b*15 on the far side through the U-shaped tube. An end portion of the heat transfer tube 20*b*15 on the near side is connected to an end portion of the heat transfer tube 20*a*15 on the near side through the U-shaped tube. An end portion of the heat transfer tube 20*a*15 on the far side is connected to an end portion of the heat transfer tube 20*a*16 on the far side through the U-shaped tube. The four heat transfer tubes 20*b*16, 20*b*15, 20*a*15, and 20*a*16 form one liquid-phase path together with, for example, the U-shaped tubes connecting the end portions thereof to each other. An outlet side of this liquid-phase path (end portion of the heat transfer tube 20*a*16 on the near side) is connected to the distributor 26 through a capillary 25*b*.

The merging portion 23*c* is connected to an end portion of the heat transfer tube 20*b*18 on the near side through a coupling tube 24*c*. An end portion of the heat transfer tube 20*b*18 on the far side is connected to an end portion of the heat transfer tube 20*b*17 on the far side through the U-shaped tube. An end portion of the heat transfer tube 20*b*17 on the near side is connected to an end portion of the heat transfer tube 20*a*17 on the near side through the U-shaped tube. An end portion of the heat transfer tube 20*a*17 on the far side is connected to an end portion of the heat transfer tube 20*a*18 on the far side through the U-shaped tube. The four heat transfer tubes 20*b*18, 20*b*17, 20*a*17, and 20*a*18 form one liquid-phase path together with, for example, the U-shaped tubes connecting the end portions thereof. An outlet side of this liquid-phase path (end portion of the heat transfer tube 20*a*18 on the near side) is connected to the distributor 26 through a capillary 25*c*.

In the heat source-side heat exchanger 3 having the refrigerant path pattern as described above, two-phase paths arranged in a region where the air velocity is the highest among all the two-phase paths (two-phase path including the heat transfer tubes 20*c*1, 20*c*2, 20*b*2, 20*b*1, 20*a*1, and 20*a*2, and two-phase path including the heat transfer tubes 20*c*3, 20*c*4, 20*b*4, 20*b*3, 20*a*3, and 20*a*4), and a liquid-phase path arranged in a region where the air velocity is the highest among all the liquid-phase paths (liquid-phase path including the heat transfer tubes 20*b*14, 20*b*13, 20*a*13, and 20*a*14) are connected in series to each other through the coupling tube 24*a*. Further, two-phase paths arranged in a region where the air velocity is the second highest among all the two-phase paths (two-phase path including the heat transfer tubes 20*c*5, 20*c*6, 20*b*6, 20*b*5, 20*a*5, and 20*a*6, and two-phase path including the heat transfer tubes 20*c*7, 20*c*8, 20*b*8, 20*b*7, 20*a*7, and 20*a*8), and a liquid-phase path arranged in a region where the air velocity is the second highest among all the liquid-phase paths (liquid-phase path including the heat transfer tubes 20*b*16, 20*b*15, 20*a*15, and 20*a*16) are connected in series to each other through the coupling tube 24*b*. In other words, the two-phase paths and the liquid-phase paths are coupled to each other in a descending order of the air velocity in their respective arrangement regions.

The two-phase paths arranged in a region where the air velocity is higher easily exhibit high performance, and hence flow rates of refrigerant to be distributed to such two-phase paths are required to be set higher than those in the other two-phase paths. In order to perform necessary subcooling, the liquid-phase paths to be connected to the two-phase paths each having the high refrigerant flow rate need to be higher in performance than the other liquid-phase paths. Thus, it is desired that, as described above, the two-phase paths and the liquid-phase paths be coupled to each other in a descending order of the air velocity in their respective arrangement regions.

Figure 9:
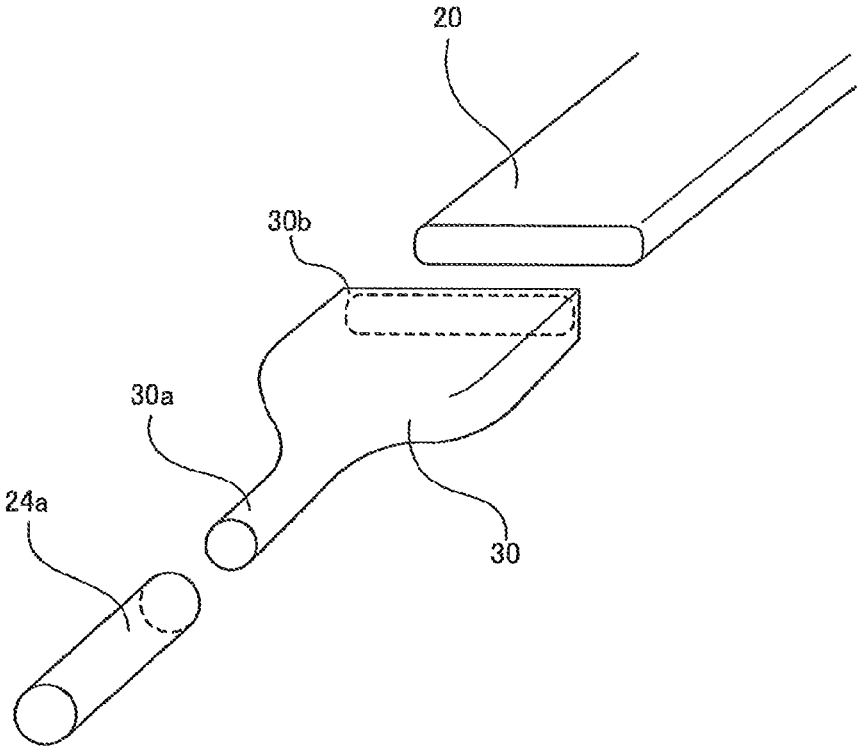
FIG. 9 is a view illustrating an example of a connecting structure between a coupling tube 24*a* and a heat transfer tube 20 in the heat source-side heat exchanger 3 of the air-conditioning apparatus 100 according to Embodiment 1 of the present invention.

Further, unlike the heat transfer tubes 20 formed of the flat tubes, circular tubes are used as the coupling tubes 24*a*, 24*b*, and 24*c* for coupling the two-phase paths and the liquid-phase paths to each other. FIG. 9 is a view illustrating an example of a connecting structure between the coupling tube 24*a* and the heat transfer tube 20. Note that, the coupling tube 24*a* actually has a curved tubular shape (for example, substantially U-tube shape), but only a straight tube part near a connecting part between the coupling tube 24*a* and the heat transfer tube 20 is illustrated in FIG. 9. As illustrated in FIG. 9, the coupling tube 24*a* and the heat transfer tube 20 are connected to each other through a joint 30. The joint 30 includes circular tube one end portion 30*a* connectable to the coupling tube 24*a*, and flat tubular another end portion 30*b* connectable to the heat transfer tube 20.

In general, in a case where the two-phase refrigerant flows through the heat transfer tube, when a gas phase flows through a central portion, and when a liquid phase flows in a form of an annular flow so as not to be separated from a tube inner wall surface, the efficiency of heat exchange is enhanced. However, as in this embodiment, when the flat tubes (for example, porous flat tubes) are used as the heat transfer tubes 20, in a microscopic view of a state of refrigerant in the pores in a cross-section of the tube, the refrigerant is in a state closer to a saturated liquid (low-quality state) toward a primary side (upstream side) of the air flow, and the refrigerant is in a state higher in proportion of the gas phase (high-quality state) toward a secondary side (downstream side) of the air flow. In other words, variation occurs in quality of the two-phase refrigerant flowing through the heat transfer tube 20. Thus, when the two-phase path and the liquid-phase path are connected to each other through the flat tube, the two-phase refrigerant flowing out of the two-phase path flows into the liquid-phase path under a state in which the variation in quality is not eliminated. Thus, in the heat transfer tube 20 in the liquid-phase path, the refrigerant on the primary side of the air flow is almost a saturated liquid, and hence the efficiency of heat exchange is decreased. A temperature efficiency of the gas-phase refrigerant on the secondary side of the air flow is low, and hence the efficiency of heat exchange is decreased. As a result, necessary subcooling may not be sufficiently performed in the liquid-phase path.

As a countermeasure, in this embodiment, the circular tubes are used as the coupling tubes 24*a*, 24*b*, and 24*c*. With use of the circular tubes as the coupling tubes 24*a*, 24*b*, and 24*c*, the flows of the two-phase refrigerant flowing out of the pores of the heat transfer tubes 20 of the two-phase paths are merged (mixed) with each other in the coupling tubes 24*a*, 24*b*, and 24*c*. With this, the flows of the two-phase refrigerant can be caused to flow into the liquid-phase paths under a state in which the variation in quality of the flows of the two-phase refrigerant is eliminated. Thus, in the heat transfer tubes 20 in the liquid-phase paths, the quality of the refrigerant in the pores on the primary side of the air flow can be increased, and hence variation in quality from the primary side to the secondary side of the air flow can be suppressed. With this, the efficiency of heat exchange can be enhanced in the liquid-phase paths, and necessary subcooling can be performed.

When an inner diameter of each of the coupling tubes 24*a*, 24*b*, and 24*c* is set excessively large, a flow rate sufficient to change a flowing pattern of the refrigerant (mixed state of a liquid flow and a gas flow) cannot be obtained. When the inner diameter is set excessively small, pressure loss is increased to cause the refrigerant to become the liquid phase in the two-phase paths. For this reason, it is preferred that the coupling tubes 24*a*, 24*b*, and 24*c* each have an inner diameter capable of securing a flow rate necessary for the mixed flows of the refrigerant and reducing the pressure loss. In this example, the inner diameter of each of the coupling tubes 24*a*, 24*b*, and 24*c* is set so that a passage cross-sectional area equivalent to a passage cross-sectional area of the heat transfer tube 20 can be obtained, but the inner diameter of each of the coupling tubes 24*a*, 24*b*, and 24*c* is not limited thereto as long as the mixed flows of the refrigerant can be formed and the pressure loss can be reduced as described above.

Further, when the circular tubes are used as the coupling tubes 24*a*, 24*b*, and 24*c*, routes for coupling the two-phase paths and the liquid-phase paths to each other can be easily three-dimensionally deformed in a complex manner. In this way, an advantage in structural implementation and an advantage of ease of processing can be obtained at low cost.

On the outlet side of the liquid-phase paths, the capillaries 25*a*, 25*b*, and 25*c*, and the distributor 26 are arranged. In the configuration of this embodiment, in order to satisfy the two conditions that the refrigerant is not subcooled in the two-phase paths and is directly caused to flow out in the two-phase state, and that necessary subcooling is performed in the liquid-phase paths, pressure loss in the heat transfer tubes 20 in both the two-phase paths and the liquid-phase paths, and pressure loss in the coupling tubes 24*a*, 24*b*, and 24*c* need to be appropriately set in accordance with the air velocity distribution. However, even when only the pressure loss in the heat transfer tubes 20 and the coupling tubes 24*a*, 24*b*, and 24*c* are adjusted, those adjustments are performed in several stages and restricted in range. Thus, it is significantly difficult to appropriately set pressure loss in accordance with the air velocity distribution to continuously vary (for example, linearly vary). As a countermeasure, in this embodiment, rough adjustment is performed by adjusting the pressure loss in the heat transfer tubes 20 in both the two-phase paths and the liquid-phase paths, and in the coupling tubes 24*a*, 24*b*, and 24*c*, and final fine adjustment is performed in the capillaries 25*a*, 25*b*, and 25*c* in the paths. With this, refrigerant distribution can be appropriately performed in accordance with the air velocity distribution.

Further, in order to reduce the pressure loss in the heat transfer tubes 20 when the heat source-side heat exchanger 3 is used as the evaporator, branch portions may be arranged in a midway of each of the two-phase paths so that the passages are bisected. Specifically, when the heat source-side heat exchanger 3 is used as the evaporator (when the refrigerant flows in a direction reverse to the arrows in FIG. 8), the two-phase paths each include a one-two path configuration including one inlet for allowing refrigerant to flow thereinto (for example, connecting portion between the coupling tube 24*a* and the merging portion 23*a*), a branch portion for bisecting a passage for the refrigerant flowing thereinto (for example, merging portion 23*a*), and two outlets for allowing flows of the refrigerant through the branched passages to flow out (for example, connecting portions between the heat transfer tubes 20*c*1 and 20*c*3 and the gas-side header portion 22). In other words, when the heat source-side heat exchanger 3 is used as the condenser, the two-phase paths each include two inlets for allowing refrigerant to flow thereinto, a merging portion for merging flows of the refrigerant flowing thereinto through the two inlets, and one outlet for allowing the merged flow of the refrigerant to flow out. With this configuration, excessive pressure loss as a result of the pressure loss adjustments for the refrigerant distribution can be reduced, and performance reduction of the heat source-side heat exchanger 3 at the time of being used as the evaporator can be suppressed. With this, efficiency of the heat source-side heat exchanger 3 can also be enhanced as the evaporator.

As described above, the air-conditioning apparatus 100 according to this embodiment includes the heat source-side heat exchanger 3 including the plurality of heat transfer tubes 20 each having a flattened shape and being arranged in parallel to each other, the heat source-side heat exchanger 3 being used at least as a condenser of a refrigeration cycle, and the outdoor fan 50 for generating flows of air passing through the heat source-side heat exchanger 3 in a predetermined air velocity distribution. The heat source-side heat exchanger 3 is configured to exchange heat between the air and the refrigerant flowing through the heat transfer tubes 20. The heat source-side heat exchanger 3 includes the plurality of refrigerant paths each including at least one of the plurality of the heat transfer tubes 20. The plurality of refrigerant paths each include the plurality of two-phase paths for allowing the gas refrigerant to flow thereinto and allowing the gas refrigerant to flow out as the two-phase refrigerant, and the plurality of liquid-phase paths for allowing the two-phase refrigerant flowing out of the plurality of two-phase paths to flow thereinto, and to flow out as the subcooled liquid refrigerant. The plurality of liquid-phase paths are arranged in the region lower in velocity of the air than the region where the plurality of two-phase paths are arranged.

In this configuration, the two-phase paths are arranged in the region where the air velocity is relatively high and the tube-outside heat transfer coefficient is high, whereas the liquid-phase paths are arranged in the region where the air velocity is relatively low and the tube-outside heat transfer coefficient is low. With this, a proportion of the liquid-phase portions in the heat transfer tubes 20 can be reduced, and hence the efficiency of heat exchange in the heat source-side heat exchanger 3 can be enhanced. Further, for example, refrigerant stagnation in lower paths (inappropriate distribution), which may be caused by influences of increase in condensing pressure (decrease in COP), increase in amount of the refrigerant, and a head, can be prevented. With this, performance of the air-conditioning apparatus 100 can be enhanced, and hence energy efficiency of the air-conditioning apparatus 100 can be enhanced.

Further, in the air-conditioning apparatus 100 according to this embodiment, the plurality of two-phase paths are respectively arranged in the regions different from each other in velocity of the air. The plurality of liquid-phase paths are respectively arranged in the regions different from each other in velocity of the air. The plurality of two-phase paths and the plurality of liquid-phase paths are correlated to each other in a descending order of the velocity of the air in the regions where the two-phase paths are respectively arranged and the regions where the liquid-phase paths are respectively arranged. The outlet sides of the plurality of two-phase paths are coupled respectively to the inlet sides of the plurality of liquid-phase paths correlated to the plurality of two-phase paths. With this configuration, the two-phase paths with high performance and the liquid-phase paths with high performance can be coupled to each other. Thus, the efficiency of heat exchange of the entire heat source-side heat exchanger 3 can be enhanced, and hence the performance of the air-conditioning apparatus 100 can be enhanced.

Still further, the air-conditioning apparatus 100 according to this embodiment further includes the coupling tubes 24*a*, 24*b*, and 24*c* for coupling the outlet sides of the plurality of two-phase paths and the inlet sides of the plurality of liquid-phase paths respectively to each other. The circular tubes are used as the coupling tubes 24*a*, 24*b*, and 24*c*. With this configuration, the variation in quality of the two-phase refrigerant flowing out of the two-phase paths can be eliminated in the coupling tubes 24*a*, 24*b*, and 24*c*. Thus, the quality of the refrigerant that flows on the primary side of the air flow in the liquid-phase paths can be increased, and hence the variation in quality from the primary side to the secondary side of the air flow can be suppressed. With this, the efficiency of heat exchange can be enhanced particularly in the liquid-phase paths in the heat source-side heat exchanger 3.

Yet further, the air-conditioning apparatus 100 according to this embodiment further includes the capillaries 25*a*, 25*b*, and 25*c* arranged respectively on downstream sides of the plurality of liquid-phase paths. Downstream sides of the capillaries 25*a*, 25*b*, and 25*c* are connected to the one distributor 26. With this configuration, the refrigerant can be distributed further in accordance with the air velocity distribution, and hence the efficiency of heat exchange in the heat source-side heat exchanger 3 can be enhanced.

Yet further, in the air-conditioning apparatus 100 according to this embodiment, the heat source-side heat exchanger 3 is used also as the evaporator of the refrigeration cycle. When the heat source-side heat exchanger 3 is used as the evaporator, the plurality of two-phase paths each include the one inlet for allowing the refrigerant to flow thereinto, the branch portion for branching the passage of the refrigerant flowing thereinto through the inlet, and the two outlets for allowing flows of the refrigerant flowing through passages branched by the branch portion to flow out of the two-phase path. With this configuration, performance reduction of the heat source-side heat exchanger 3 at the time of being used as the evaporator can be suppressed. With this, the efficiency of the heat source-side heat exchanger 3 can also be enhanced as the evaporator.

Other Embodiments

The present invention is not limited to the embodiment described above, and various modifications may be made thereto.

For example, the present invention is applicable not only to the heat source-side heat exchanger 3 as exemplified in the embodiment described above, but also to the use-side heat exchangers 101.

Further, each of the above-mentioned embodiments and modified examples may be carried out in combination with each other.

REFERENCE SIGNS LIST

1 compressor 2 four-way valve 3 heat source-side heat exchanger 3*a* upper region3*b* lower region 15 refrigerant pipe 20, 20*a*1-20*a*18, 20*b*1-20*b*18, 20*c*1-20*c*12 heat transfer tube 21 heat transfer fin 22 gas-side header portion 23*a*, 23*b*, 23*c* merging portion 24*a*, 24*b*, 24*c* coupling tube 25*a*, 25*b*, 25*c* capillary 26 distributor 30 joint 30*a* one end portion 30*b* other end portion 50 outdoor fan 100 air-conditioning apparatus 101 use-side heat exchanger 102 expansion device A outdoor unit B, B1, B2 indoor unit

The invention claimed is:

1. An air-conditioning apparatus, comprising:

a heat exchanger including heat transfer tubes, wherein each heat transfer tube has a flattened shape, the heat transfer tubes are arranged in parallel to each other, and the heat exchanger is used at least as a condenser of a refrigeration cycle; and a fan for generating a flow of air passing through the heat exchanger in an air velocity distribution in which a velocity of the air is increased toward an upper portion and decreased toward a lower portion, wherein the heat exchanger is configured to exchange heat between the air and refrigerant flowing through the heat transfer tubes, the heat exchanger includes refrigerant paths, wherein each refrigerant path has at least one of the heat transfer tubes, the refrigerant paths include first refrigerant paths for allowing gas refrigerant to flow into the first refrigerant paths and allowing the gas refrigerant to flow out as two-phase refrigerant, and second refrigerant paths for allowing the two-phase refrigerant flowing out of the first refrigerant paths to flow into the second refrigerant paths and to flow out of the second refrigerant paths as subcooled liquid refrigerant, the second refrigerant paths are arranged in a second region, in which the velocity of the air is lower than the velocity of the air in a first region, where the first refrigerant paths are arranged, the first region is located above the second region, the first refrigerant paths are respectively arranged at locations different from each other in the velocity of the air and are arranged in a descending order that corresponds to a descending velocity of the flow of air, the second refrigerant paths are respectively arranged at locations different from each other in the velocity of the air and are arranged in a descending order that corresponds to the descending velocity of the flow of air, the first refrigerant paths and the second refrigerant paths correspond to each other from top to bottom in the locations where the first refrigerant paths are respectively arranged and the locations where the second refrigerant paths are respectively arranged such that one of the first refrigerant paths that is exposed to a highest velocity air flow of the first region corresponds to one of the second refrigerant paths that is exposed to a highest velocity air flow of the second region, and one of the first refrigerant paths that is exposed to a lowest velocity air flow of the first region corresponds to one of the second refrigerant paths that is exposed to a lowest velocity air flow of the second region, and outlet sides of the first refrigerant paths are coupled separately and individually to inlet sides of the second refrigerant paths, which correspond to the first refrigerant paths.

2. The air-conditioning apparatus of claim 1, further comprising coupling tubes for coupling the outlet sides of the first refrigerant paths and the inlet sides of the second refrigerant paths respectively to each other, wherein the coupling tubes include circular tubes.

3. The air-conditioning apparatus of claim 1, further comprising capillaries arranged respectively on downstream sides of the second refrigerant paths, wherein downstream sides of the capillaries are connected to one distributor.

4. The air-conditioning apparatus of claim 1, wherein the heat exchanger is used also as an evaporator of the refrigeration cycle, and wherein, when the heat exchanger is used as the evaporator, each of the first refrigerant paths includes one inlet for allowing the refrigerant to flow into one of the first refrigerant paths, a branch portion for branching a passage of the refrigerant flowing into the branch portion through the one inlet, and two outlets for allowing flows of the refrigerant flowing through passages branched by the branch portion to flow out of the one of the first refrigerant paths.

5. The air-conditioning apparatus of claim 2, further comprising a joint including one circular tube end portion connected to one of the coupling tubes and another end portion connected to one of the heat transfer tubes, wherein the one of the coupling tubes and the one of the heat transfer tubes are connected through the joint.

6. The air-conditioning apparatus of claim 1, wherein the outlet sides of the first refrigerant paths are independently and directly coupled to respective inlet sides of the second refrigerant paths.

7. The air-conditioning apparatus of claim 1, wherein the outlet sides of the first refrigerant paths are independently and directly coupled to respective inlet sides of the second refrigerant paths so that refrigerant that is in a single-phase state or that includes mostly single-phase refrigerant is directed from a downstream end of each of the first paths, where the velocity of the air is higher, to an upstream end of a corresponding one of the second paths, where the velocity of the air is lower, to improve the heat transfer efficiency of the heat exchanger.

8. The air-conditioning apparatus of claim 1, wherein the heat exchanger further includes coupling tubes, and wherein the outlet sides of the first refrigerant paths are coupled to the inlet sides of the corresponding second refrigerant paths by the coupling tubes, respectively.

9. The air conditioning apparatus of claim 1, wherein the first refrigerant paths are equal in number to the second refrigerant paths.

* * * * *